US009138042B2

(12) United States Patent
Scicluna

(10) Patent No.: US 9,138,042 B2
(45) **Date of Patent: *Sep. 22, 2015**

(54) ARTICULABLE SHOULDER STRAP

(71) Applicant: TUMI, INC., South Plainfield, NJ (US)

(72) Inventor: Paul V. Scicluna, Penndel, PA (US)

(73) Assignee: TUMI, INC., South Plainfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/556,974

(22) Filed: Dec. 1, 2014

(65) Prior Publication Data

US 2015/0083766 A1 Mar. 26, 2015

Related U.S. Application Data

(63) Continuation of application No. 12/583,648, filed on Aug. 24, 2009, now Pat. No. 8,899,455.

(51) Int. Cl.

| | |
|---|---|
| ***A45F 3/02*** | (2006.01) |
| ***A45F 3/14*** | (2006.01) |
| ***A45F 3/12*** | (2006.01) |

(52) U.S. Cl.

CPC ... *A45F 3/14* (2013.01); *A45F 3/02* (2013.01); *A45F 3/12* (2013.01); *A45F 2003/142* (2013.01)

(58) Field of Classification Search

CPC ..... A45F 2003/142; A45F 3/02; A45F 3/12; A45F 3/14

USPC ..... 224/264, 609, 257, 600, 607, 608, 224/610–622, 642, 643, 258

See application file for complete search history.

(56) References Cited

U.S. PATENT DOCUMENTS

| | | | | |
|---|---|---|---|---|
| 2,808,973 | A * | 10/1957 | Gobble | 224/264 |
| 3,317,098 | A | 5/1967 | Auraen | |
| 5,544,795 | A | 8/1996 | Perrin | |
| 5,765,735 | A | 6/1998 | Kimchi et al. | |
| 5,860,769 | A | 1/1999 | Seligman | |
| 5,887,770 | A * | 3/1999 | Covell | 224/153 |
| 5,915,606 | A | 6/1999 | Jensen | |
| 6,371,346 | B1 | 4/2002 | Sharma | |
| 6,378,746 | B1 | 4/2002 | Miller | |
| 6,647,555 | B2 | 11/2003 | Yamaguchi et al. | |
| D553,328 | S * | 10/2007 | King | D2/624 |
| 7,387,226 | B2 | 6/2008 | Porter | |
| 2007/0029356 | A1 * | 2/2007 | Moriguchi et al. | 224/160 |
| 2007/0261213 | A1 * | 11/2007 | Nolan et al. | 24/300 |
| 2008/0142557 | A1 | 6/2008 | Hess et al. | |

* cited by examiner

*Primary Examiner* — Brian D Nash
*Assistant Examiner* — Corey Skurdal
(74) *Attorney, Agent, or Firm* — Lando & Anastasi, LLP

(57) ABSTRACT

A combination mobile shoulder strap and stationary shoulder cushion for carrying a receptacle, via appropriate releasable connectors, without movement of the stationary shoulder cushion and without the consequences caused at least by such movement to a wearer. The combination includes a stationary shoulder cushion, a pair of mobile strap elements, and apparatus that laterally pivotally attaches the pair of mobile strap elements to the stationary shoulder cushion so as to allow the pair of mobile strap elements to carry the receptacle, via the appropriate releasable connectors, and move relative to the stationary shoulder cushion, while the stationary shoulder cushion does not move so as to eliminate the consequences to a wearer caused at least by such movement of the pair of mobile strap elements. The apparatus is underlaid by the stationary shoulder cushion so as to eliminate the consequences caused by the apparatus undesirably engaging the wearer.

15 Claims, 5 Drawing Sheets

ARTICULABLE SHOULDER STRAP

CROSS REFERENCE TO RELATED APPLICATIONS

The present application is a continuation of and claims priority to U.S. patent application Ser. No. 12/583,648, filed Aug. 24, 2009 which is incorporated herein by reference in its entirety.

BACKGROUND OF THE INVENTION

A. Field of the Invention

The embodiments of the present invention relate to a combination shoulder strap and pad for carrying a receptacle, and more particularly, the embodiments of the present invention relate to a combination mobile shoulder strap and stationary shoulder cushion for carrying a receptacle, via appropriate releasable connectors, without movement of the stationary shoulder cushion and without the consequences caused at least by such movement to a wearer.

B. Description of the Prior Art

Shoulder straps either go over a bag-side shoulder or across a wearer's torso. Over the bag-side shoulder, the strap's shoulder cushion tends to slip off, and, the bag tends to migrate rearwardly of the wearer and dip forwardly downwardly. When the strap goes across the wearer's torso, its shoulder cushion tends to cut into the wearer's neck.

Using a wider shoulder cushion does not solve these problems. Using a curved shoulder cushion helps somewhat, but is not satisfactory when the shoulder strap goes across the body because the shoulder cushion still tends to cut into the neck of the wearer.

Thus, there exists a need for a combination shoulder strap and shoulder cushion that allows the bag it is carrying to stay level, and whose shoulder cushion does not slide off the wearer's bag-side shoulder or cut into the wearer's neck when its shoulder strap is worn across the torso of the wearer.

Numerous innovations for straps have been provided in the prior art, which will be described below in chronological order to show advancement in the art, and which is incorporated herein by reference thereto. Even though these innovations may be suitable for the individual purposes which they address, nevertheless, they differ from the embodiments of the present invention in that they do not teach a combination mobile shoulder strap and stationary shoulder cushion for carrying a receptacle, via appropriate releasable connectors, without movement of the stationary shoulder cushion and without the consequences caused at least by such movement to a wearer.

(1) U.S. Pat. No. 5,765,735 to Kimchi et al.

U.S. Pat. No. 5,765,735 issued to Kimchi et al. on Jun. 16, 1998 in U.S. class 224 and subclass 264 teaches a combination shoulder strap and anatomical pad to be used on a carrying bag, including a pad configured to rest on a shoulder of a user and to diverge from an apex at the meeting point of the pad and the user's shoulder, and a strap including two diverging strap segments. The longitudinal axes of the strap segments meet at an obtuse angle in the area of the apex of the pad. The transverse width of the pad is narrower in the area of the apex by virtue of an indentation formed in the pad within the confines of the formed obtuse angle. The pad is further provided with padding material positioned within each diverging segment thereof adjacent the narrowed area. The padding is graduated in thickness along its width and has a maximum thickness in the areas bracketing the indentation.

(2) U.S. Pat. No. 6,378,746 to Miller.

U.S. Pat. No. 6,378,746 issued to Miller on Apr. 30, 2002 in U.S. class 224 and subclass 258 teaches a sling for transporting a conventional infant carrier seat, which has a generally rigid body provided with a pivoted carrier handle. The sling includes a sling member having a padded upper segment fabricated from a length of resilient material and having an elongated slot formed therein dimensioned to receive a main strap element adapted to define a first adjustable closed loop opening. The main strap element is further provided with an auxiliary strap element that cooperates with the main strap element to define a second adjustable closed loop opening that captively receives the handle of the conventional infant carrier seat.

(3) U.S. Pat. No. 6,647,555 to Yamaguchi et al.

U.S. Pat. No. 6,647,555 issued to Yamaguchi et al. on Nov. 18, 2003 in U.S. class 2 and subclass 338 teaches a belt-like article having fastening elements continuously attached along an entire periphery of a long tape main body. The belt-like article further includes engaging apparatus capable of engaging with/disengaging from each other, each of which has an engaging portion provided at a predetermined position in a longitudinal direction of the tape main body. By winding the belt-like article spirally about an end portion thereof so as to engage the opposing fastening elements successively, a diversified type of the storage bodies can be obtained. Further, by engaging the engaging apparatus with each other, the belt-like article can be used as a neck strap for hanging the storage body for accommodating an object. Therefore, the belt-like article is provided with not only an application as the belt-like article, but also an application as a storage body for various objects that are functionally related to each other so that it can be used sufficiently for practical purpose.

(4) United States Patent Application Publication Number 2007/0261213 to Nolan et al.

United States Patent Application Publication Number 2007/0261213 published to Nolan et al. on Nov. 15, 2007 in U.S. class 24 and subclass 300 teaches clipping an elastic apparatus between the ends of a shoulder strap and a portable object. A short elastic suspender includes an elastic strap to be removably attached by a first connector to the D-ring of a portable object. The other end of the suspender has a D-ring connector configured to removably be attached to the snap/hook fastener of the original shoulder-carrying strap of the portable object.

(5) U.S. Pat. No. 7,387,226 to Porter.

U.S. Pat. No. 7,387,226 issued to Porter on Jun. 17, 2008 in U.S. class 224 and subclass 259 teaches a golf bag carrying system in the form of a triple strap carrier, including a first and a second strap secured to the golf bag to define first and second shoulder openings, respectively. The first strap second end and the second strap first end are attached to a first ring, and the second strap is led through a second ring at a central (second) location at a mid-portion of the bag. The other ends of the first and second straps are secured to the golf bag longitudinally on opposite sides of the second location at first and third locations, respectively. A third strap is attached to the first ring and to the bag at a fourth location below the third location. The mounts for securing the straps to the bag, and the straps themselves, preferably are selectively adjustable to balance the bag in single-shoulder and dual-shoulder carrying modes.

It is apparent that numerous innovations for straps have been provided in the prior art, which are adapted to be used. Furthermore, even though these innovations may be suitable for the specific individual purposes to which they address, however, they would not be suitable for the purposes of the embodiments of the present invention as heretofore described, namely, a combination mobile shoulder strap and stationary shoulder cushion for carrying a receptacle, via appropriate releasable connectors, without movement of the stationary shoulder cushion and without the consequences caused at least by such movement to a wearer.

SUMMARY OF THE INVENTION

Thus, an object of the embodiments of the present invention is to provide a combination mobile shoulder strap and stationary shoulder cushion for carrying a receptacle, via appropriate releasable connectors, without movement of the stationary shoulder cushion and without the consequences caused at least by such movement to a wearer, which avoids the disadvantages of the prior art.

Briefly stated, another object of the embodiments of the present invention is to provide a combination mobile shoulder strap and stationary shoulder cushion for carrying a receptacle, via appropriate releasable connectors, without movement of the stationary shoulder cushion and without the consequences caused at least by such movement to a wearer. The combination includes a stationary shoulder cushion, a pair of mobile strap elements, and apparatus that laterally pivotally attaches the pair of mobile strap elements to the stationary shoulder cushion so as to allow the pair of mobile strap elements to carry the receptacle, via the appropriate releasable connectors, and move relative to the stationary shoulder cushion, while the stationary shoulder cushion does not move so as to eliminate the consequences to a wearer caused at least by such movement of the pair of mobile strap elements. The apparatus is underlaid by the stationary shoulder cushion so as to eliminate the consequences caused by the apparatus undesirably engaging the wearer.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

A. General

Figure 1B:
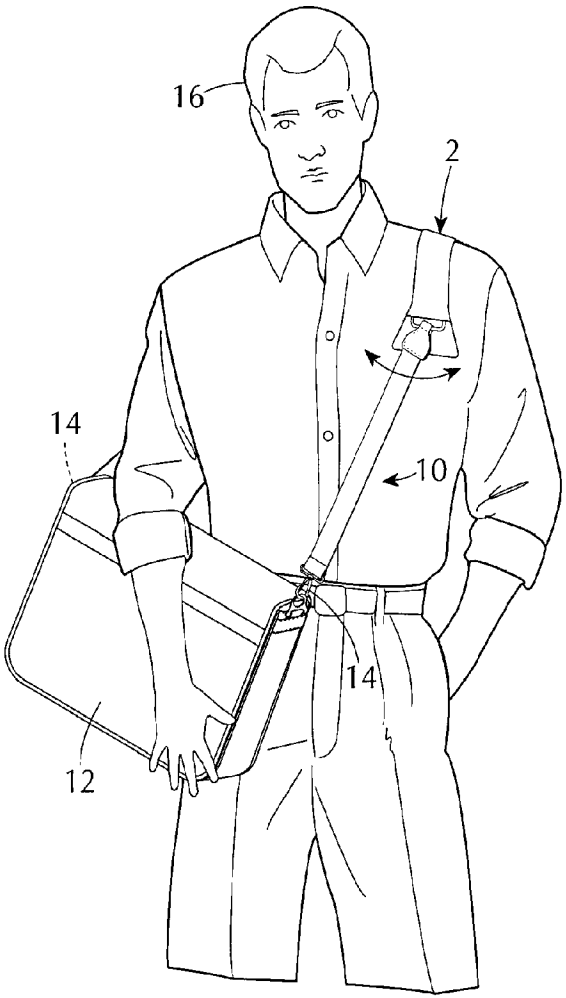
FIG. 1B is a diagrammatic perspective view of a first embodiment of the embodiments of the combination mobile shoulder strap and stationary shoulder cushion of the present invention carrying across the torso of a wearer a receptacle, via appropriate releasable connectors, without movement of the stationary shoulder cushion and without the consequences caused at least by such movement to the wearer.

10 combination mobile shoulder strap and stationary shoulder cushion of embodiments of present invention for carrying receptacle 12, via appropriate releasable connectors 14, without movement of stationary shoulder cushion and without consequences caused at least by such movement to wearer 16

12 receptacle

14 appropriate releasable connectors

16 wearer

B. Overall Configuration of Combination Mobile Shoulder Strap and Stationary Shoulder Cushion 10

18 stationary shoulder cushion

20 pair of mobile strap elements

22 apparatus for laterally pivotally attaching pair of mobile strap elements 20 to stationary shoulder cushion 18 so as to allow pair of mobile strap elements 20 to carry receptacle 12, via appropriate releasable connectors 14, and move relative to stationary shoulder cushion 18, while stationary shoulder cushion 18 does not move so as to eliminate consequences to wearer 16 caused at least by such movement of pair of mobile strap elements 20

23 ARROWS indicating laterally pivotal movement of pair of mobile strap elements 20 relative to stationary shoulder cushion 18

24 opposing ends of stationary shoulder cushion 18

25 first ends of pair of mobile strap elements 20, respectively

26 second ends of pair of mobile strap elements 20, respectively

27 axial sides of stationary shoulder cushion 18

C. Specific Configuration of Apparatus 22

28 pair of "D" rings of apparatus 22

30 straight portions of pair of "D" rings 28 of apparatus 22, respectively

32 curved portions of pair of "D" rings 28 of apparatus 22, respectively

33 connection loops of first ends 26 of pair of mobile strap elements 20 of apparatus 22, respectively

34 pair of flexible loops of apparatus 22

36 cover of apparatus 22

D. First Alternate Embodiment of Stationary Shoulder Cushion 40

40 stationary shoulder cushion

42 pair of cushion bumpers of stationary shoulder cushion 40

44 axial sides of stationary shoulder cushion 40

E. Second Alternate Embodiment of Stationary Shoulder Cushion 50

50 stationary shoulder cushion.

5. Detailed Description of the Preferred Embodiments

A. General

Figure 1A:
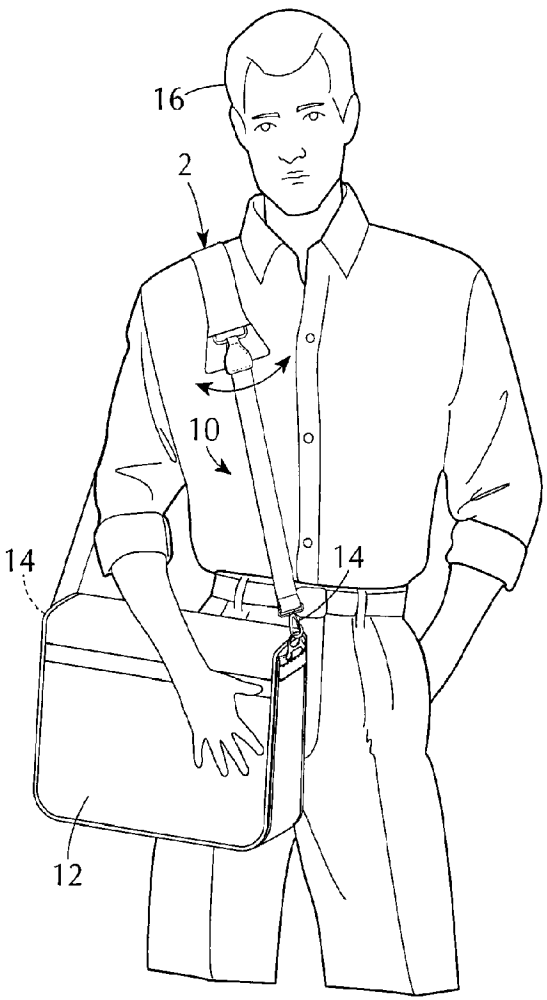
FIG. 1A is a diagrammatic perspective view of a first embodiment of the embodiments of the combination mobile shoulder strap and stationary shoulder cushion of the present invention carrying over the bag-side shoulder of a wearer a receptacle, via appropriate releasable connectors, without movement of the stationary shoulder cushion and without the consequences caused at least by such movement to the wearer.

Referring now to the figures, in which like numerals indicate like parts, and particularly to FIGS. 1A and 1B, which are, respectively, a diagrammatic perspective view of a first embodiment of the embodiments of the combination mobile shoulder strap and stationary shoulder cushion of the present invention carrying over the bag-side shoulder of a wearer a receptacle, via appropriate releasable connectors, without movement of the stationary shoulder cushion and without the consequences caused at least by such movement to the wearer, and a diagrammatic perspective view of a first embodiment of the embodiments of the combination mobile shoulder strap and stationary shoulder cushion of the present invention carrying across the torso of a wearer a receptacle, via appropriate releasable connectors, without movement of the stationary shoulder cushion and without the consequences caused at least by such movement to the wearer, the combination mobile shoulder strap and stationary shoulder cushion of the embodiments of the present invention is shown generally at 10 for carrying a receptacle 12, via appropriate releasable connectors 14 without movement of the stationary shoulder cushion and without the consequences caused at least by such movement to a wearer 16.

B. The Overall Configuration of the Combination Mobile Shoulder Strap and Stationary Shoulder Cushion 10

Figure 2:
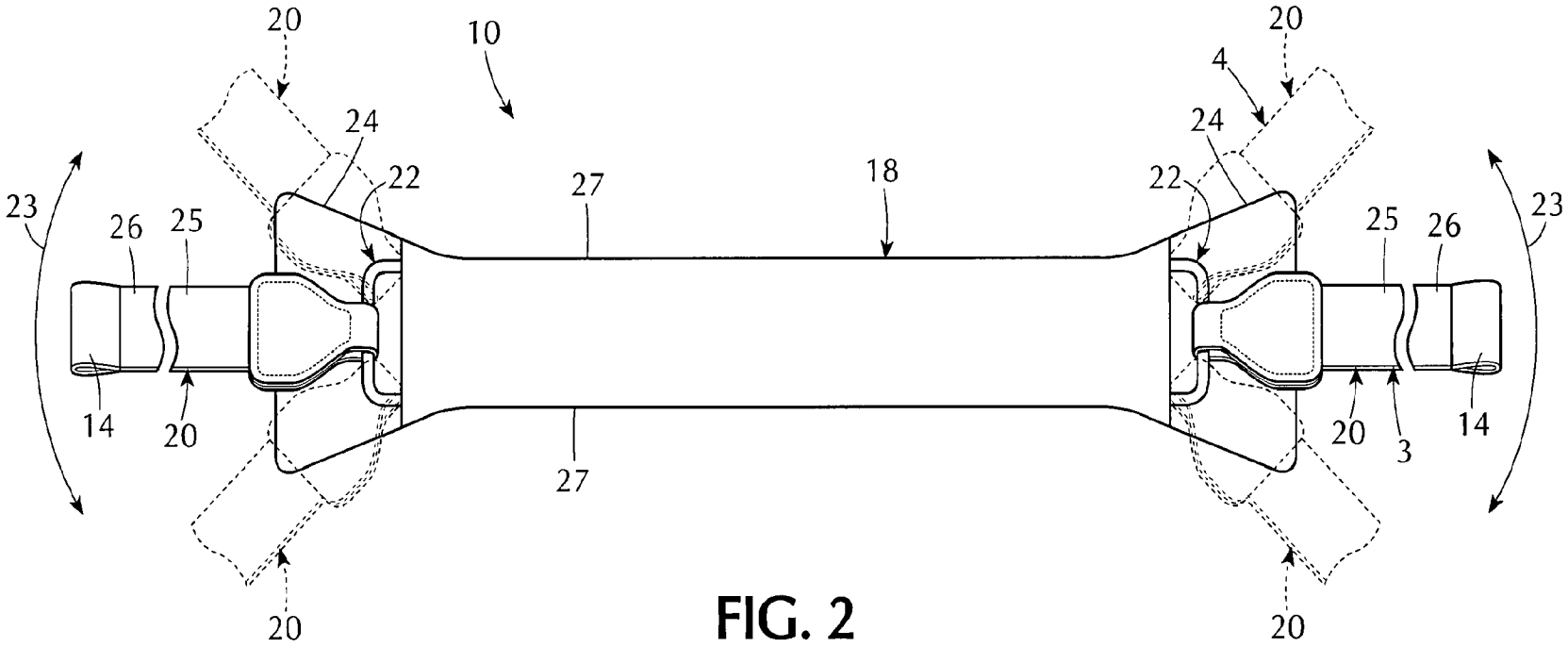
FIG. 2 is an enlarged diagrammatic perspective view of the area generally identified by ARROW 2 in FIG. 1 of the combination mobile shoulder strap and stationary shoulder cushion of the embodiments of the present invention.

The overall configuration of the combination mobile shoulder strap and stationary shoulder cushion 10 can best be seen in FIG. 2, which is an enlarged diagrammatic perspective view of the area generally identified by ARROW 2 in FIG. 1 of the combination mobile shoulder strap and stationary shoulder cushion of the embodiments of the present invention, and as such, will be discussed with reference thereto.

The combination mobile shoulder strap and stationary shoulder cushion 10 comprises a stationary shoulder cushion 18, a pair of mobile strap elements 20, and apparatus 22 for laterally pivotally attaching the pair of mobile strap elements 20 to the stationary shoulder cushion 18 so as to allow the pair of mobile strap elements 20 to carry the receptacle 12, via the appropriate releasable connectors 14, and move relative to the stationary shoulder cushion 18, while the stationary shoulder cushion 18 does not move so as to eliminate the consequences to the wearer 16 caused at least by such movement of the pair of mobile strap elements. See ARROWS 23 indicating the laterally pivotal movement of the pair of mobile strap elements 20 relative to the stationary shoulder cushion 18.

The apparatus 22 is underlaid by the stationary shoulder cushion 18 so as to eliminate the consequences caused by the apparatus 22 undesirably engaging the wearer 16.

The stationary shoulder cushion 18 has opposing ends 24 from which first ends 25 of the pair of mobile strap elements 20 laterally pivotally extend, respectively, and axial sides 27.

The opposing ends 24 of the stationary shoulder cushion 18 diverge outwardly so as to further eliminate the consequences caused by the apparatus 22 undesirably engaging the wearer 16.

The pair of mobile strap elements 20 have second ends 26 at which are disposed the appropriate connectors 14, respectively.

C. The Specific Configuration of the Apparatus 22

Figure 4:
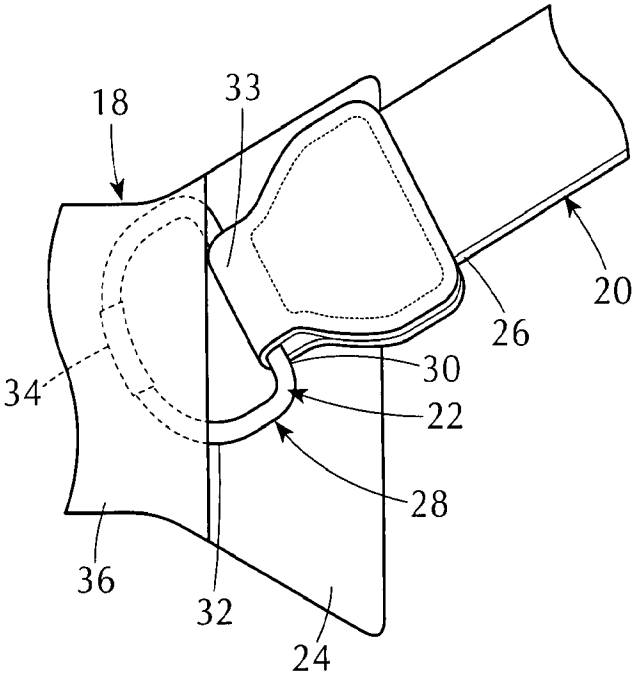
FIG. 4 is an enlarged diagrammatic perspective view of the area generally identified by ARROW 4 in FIG. 2.
Figure 3:
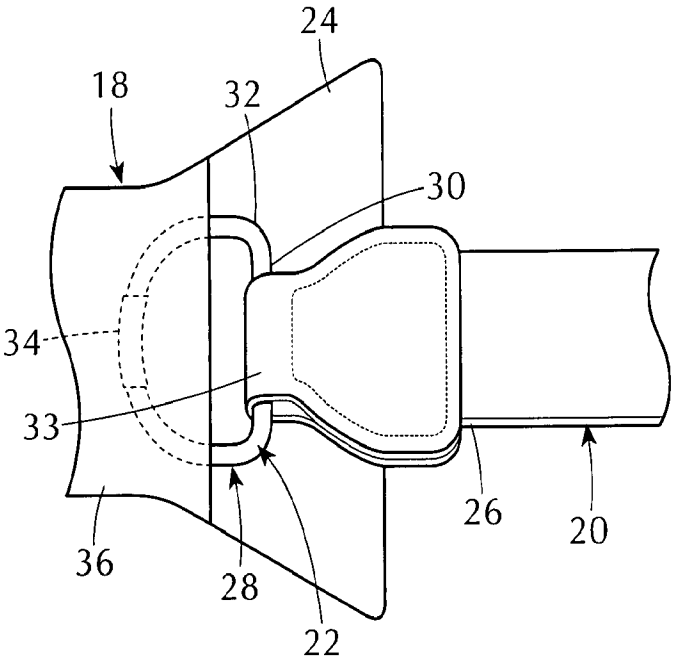
FIG. 3 is an enlarged diagrammatic perspective view of the area generally identified by ARROW 3 in FIG. 2.

The specific configuration of the apparatus 22 can best be seen in FIGS. 3 and 4, which are, respectively, an enlarged diagrammatic perspective view of the area generally identified by ARROW 3 in FIG. 2, and an enlarged diagrammatic perspective view of the area generally identified by ARROW 4 in FIG. 2, and as such, will be discussed with reference thereto.

The apparatus 22 comprises a pair of "D" rings 28 with straight portions 30 and curved portions 32, respectively. The straight portions 30 of the pair of "D" rings 28 of the apparatus 22 extend from the first ends 26 of the pair of mobile strap elements 20, respectively, by way of the first ends 26 of the pair of mobile strap elements 20 looping therearound by connection loops 33, and overlay the opposing ends 24 of the stationary shoulder cushion 18, respectively, to eliminate the consequences caused by the pair of "D" rings 28 of the apparatus 22 undesirably engaging the wearer 16.

The apparatus 22 further comprises a pair of flexible loops 34. The pair of flexible loops 34 of the apparatus 22 are disposed at the opposing ends 24 of the stationary shoulder cushion 18, respectively, and laterally pivotally receive the curved portions 32 of the pair of "D" rings 28 of the apparatus 22, respectively, so as to allow the curved portions 32 of the pair of "D" rings 28 of the apparatus 22 to move laterally pivotally relative to the pair of flexible loops 34 of the apparatus 22, respectively, and the pair of mobile strap elements 20 attached to the straight portions 30 of the pair of "D" rings 28 of the apparatus 22, respectively, to move laterally pivotally therewith (FIG. 4).

The apparatus 22 further comprises a cover 36. The cover 36 of the apparatus 22 overlays the stationary shoulder cushion 18, and extends from substantially over one "D" ring 28 of the apparatus 22 to substantially over the other "D" ring 28 of the apparatus 22 for preventing the wearer 16 from getting inadvertently caught by the pair of "D" rings 28 of the apparatus 22.

D. The First Alternate Embodiment of the Stationary Shoulder Cushion 40

Figure 5:
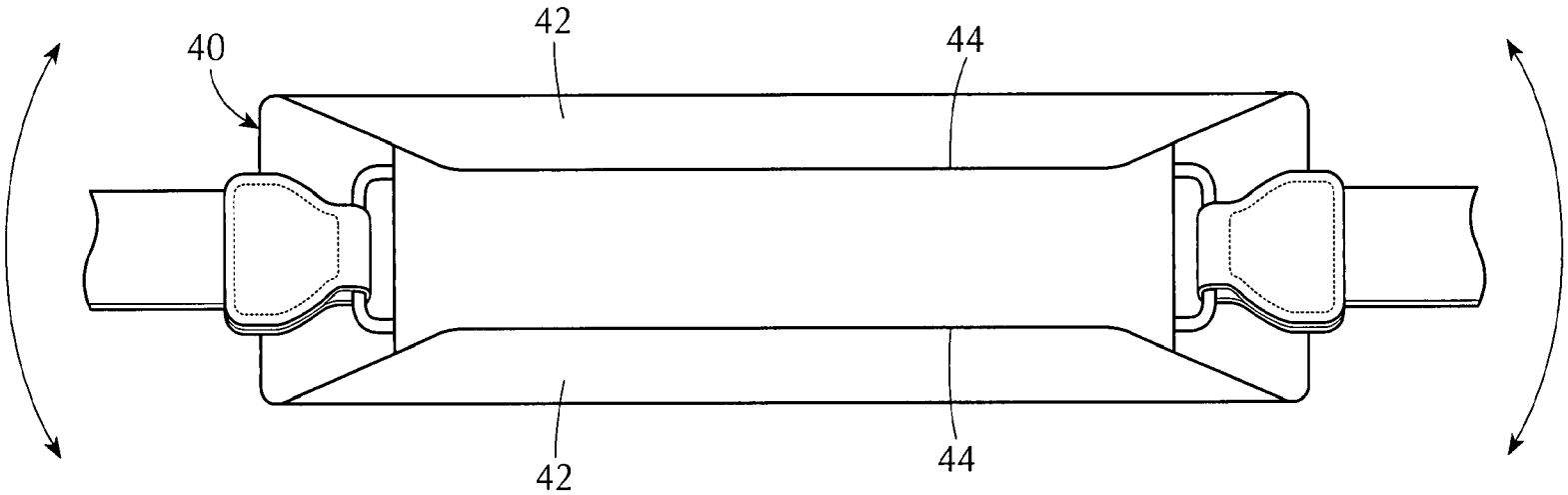
FIG. 5 is a diagrammatic perspective view of a second embodiment of the embodiments of the combination mobile shoulder strap and stationary shoulder cushion of the present invention.

The first alternate embodiment of the stationary shoulder cushion 40 can best be seen in FIG. 5, which is a diagrammatic perspective view of a second embodiment of the embodiments of the combination mobile shoulder strap and stationary shoulder cushion of the present invention, and as such, will be discussed with reference thereto.

The stationary shoulder cushion 40 is similar to the stationary shoulder cushion 18, but with the addition of a pair of cushion bumpers 42. The pair of cushion bumpers 42 of the stationary shoulder cushion 40 extend along the axial sides 44 of the stationary shoulder cushion 40, respectively, to provide further comfort for the wearer 16.

E. The Second Alternate Embodiment of the Stationary Shoulder Cushion 50

Figure 6:
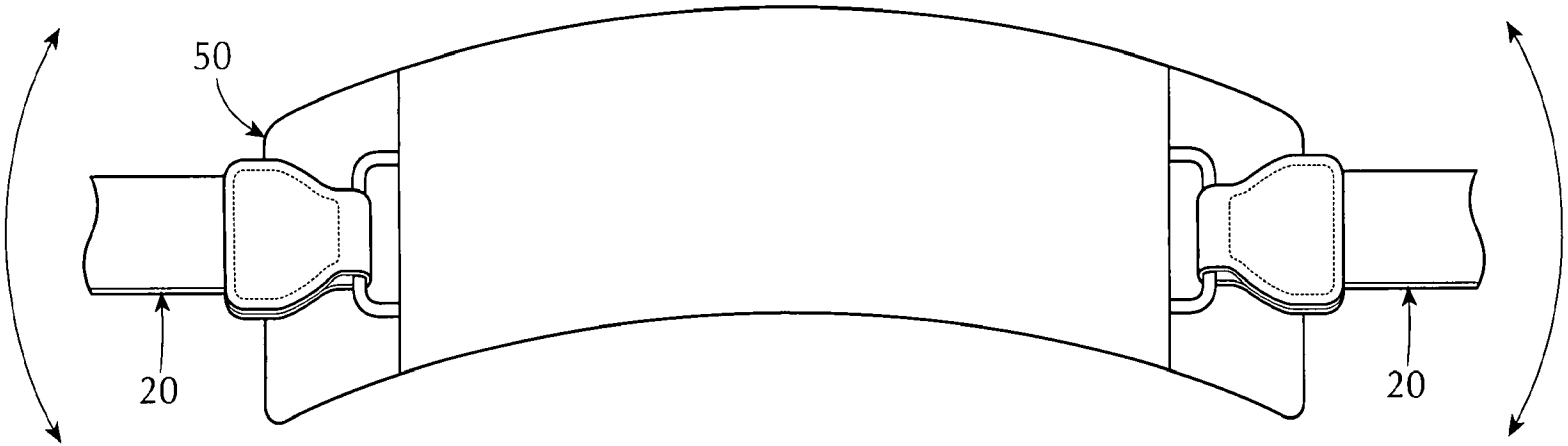
FIG. 6 is a diagrammatic perspective view of a third embodiment of the embodiments of combination mobile shoulder strap and stationary shoulder cushion of the present invention.

The second alternate embodiment of the stationary shoulder cushion 50 can best be seen in FIG. 6, which is a diagrammatic perspective view of a third embodiment of the embodiments of the combination mobile shoulder strap and stationary shoulder cushion of the present invention, and as such, will be discussed with reference thereto.

The stationary shoulder cushion 50 is similar to the stationary shoulder cushions 18 and 40, but is axially curved to not touch the neck of the wearer 16 when the pair of mobile strap elements 20 are worn across the torso of the wearer 16.

F. The Impressions

It will be understood that each of the elements described above or two or more together may also find a useful application in other types of constructions differing from the types described above.

While the embodiments of the present invention have been illustrated and described as embodied in an articulable shoulder strap, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A shoulder strap comprising:

a shoulder cushion having a cover on a top surface thereof, the shoulder cushion and the cover having axial sides, and a pair of flexible loops at opposing ends of the shoulder cushion, the flexible loops being pivotably attached to the shoulder cushion:

a pair of opposing D-rings, each of the D-rings comprising a straight portion, a curved portion, a first lateral side and a second lateral side, and each of the D-rings being received by one of the flexible loops; and a pair of strap elements, each of the strap elements comprising a connection loop on a first end being affixed to one of the D-rings;

wherein the flexible loops are covered by the cover on the top surface of the shoulder cushion, the cover is attached to the shoulder cushion along substantially the entire length of the axial sides of the cover, and in an at rest position of one of the strap elements and the D-ring, the straight portion of each D-ring remains exposed from the cover; and wherein the shoulder strap is configured such that when one of the strap elements is rotated about the flexible loop in the direction of the first lateral side of the D-ring to a first position of the strap element and the D-ring, at least a portion the first lateral side of the D-ring becomes hidden under the cover and substantially all of the second lateral side of the D-ring becomes exposed outside of the cover.

2. The shoulder strap of claim 1, wherein in the shoulder cushion has a pair of cushion bumpers.

3. The shoulder strap of claim 2, wherein the pair of cushion bumpers of said shoulder cushion extends along the axial sides of the shoulder cushion, respectively.

4. The shoulder strap of claim 1, wherein the shoulder cushion diverges outwardly at the opposing ends.

5. The shoulder strap of claim 4, wherein the cover diverges outwardly at the opposing ends of the cover to cover a portion of the diverging ends of the shoulder cushion.

6. The shoulder strap of claim 5, wherein the cover diverges outwardly from an innermost portion of the flexible loops to an outermost edge of the cover.

7. The shoulder strap of claim 1, wherein the stationary shoulder cushion is axially curved.

8. The shoulder strap of claim 1, wherein each flexible loop is looped around the curved portion of a respective D-ring.

9. The shoulder strap of claim 1, wherein the connection loop of each strap element loops around the straight portion of one of the D-rings.

10. The shoulder strap of claim 1, wherein the pair of opposing D-rings overlay the opposing ends of the shoulder cushion.

11. The shoulder strap of claim 1, wherein each of said flexible loops laterally pivotally receives said curved portion of the respective D-ring so as to allow the curved portion of the D-ring to move laterally pivotally with respect to the flexible loop.

12. The shoulder strap of claim 1, wherein each strap element comprises a releasable connector on a second end thereof for attaching to a receptacle.

13. The shoulder strap of claim 1, wherein in the at rest position of the strap element and the D-ring, at least a portion of the first lateral side and the second lateral of the D-ring remains exposed from the cover.

14. The shoulder strap of claim 1, wherein in the at rest position of the strap element and the D-ring , substantially all of the curved portion of the D-ring is covered by the cover.

15. The shoulder strap of claim 1, wherein the shoulder strap is configured such that when one of the strap elements is rotated about the flexible loop in the direction of the second lateral side of the D-ring to a second position of the strap element and the D-ring, at least a portion the second lateral side of the D-ring becomes hidden under the cover and substantially all of the first lateral side of the D-ring becomes exposed outside of the cover.

* * * * *

UNITED STATES PATENT AND TRADEMARK OFFICE

CERTIFICATE OF CORRECTION

PATENT NO. : 9,138,042 B2
APPLICATION NO. : 14/556974
DATED : September 22, 2015
INVENTOR(S) : Paul V. Scicluna It is certified that error appears in the above-identified patent and that said Letters Patent is hereby corrected as shown below:

Claims

At column 7, claim number 2, line number 34, after the word “wherein” delete “in”.

Signed and Sealed this
Second Day of February, 2016

Michelle K. Lee

Michelle K. Lee
*Director of the United States Patent and Trademark Office*